United States Patent [19]

Kuo et al.

[11] 4,186,286

[45] Jan. 29, 1980

[54] RADIO FREQUENCY INTERFERENCE SUPPRESSING IGNITION DISTRIBUTOR ROTOR

[75] Inventors: Wey-Chaung Kuo, Bloomfield Hills; Hwei P. Hsu, Birmingham, both of Mich.

[73] Assignee: General Motors Corporation, Detroit, Mich.

[21] Appl. No.: 950,048

[22] Filed: Oct. 10, 1978

Related U.S. Application Data

[63] Continuation-in-part of Ser. No. 848,243, Nov. 3, 1977, abandoned.

[51] Int. Cl.[2] ..... H01H 19/00; F02P 1/00

[52] U.S. Cl. ..... 200/19 DR; 123/146.5 A; 123/148 P; 200/237

[58] Field of Search ..... 200/19 DR, 19 DC, 19 R, 200/237, 246, 262, 267, 268, 270; 123/146.5 A, 148 R, 148 P

[56] References Cited

U.S. PATENT DOCUMENTS

| | | | |
|---|---|---|---|
| 2,227,972 | 1/1941 | Hood et al. | 200/19 |
| 3,035,141 | 5/1962 | Goral | 200/270 X |
| 3,887,780 | 6/1975 | Crim | 200/19 DR |
| 3,941,107 | 3/1976 | Rockwell | 200/19 DR X |
| 4,007,342 | 2/1977 | Makino et al. | 200/19 R |
| 4,039,787 | 8/1977 | Hori et al. | 200/19 R |
| 4,074,090 | 2/1978 | Hayashi et al. | 200/19 DR |
| 4,082,926 | 4/1978 | Marks et al. | 200/19 DR |
| 4,135,066 | 1/1979 | Yamanaka et al. | 200/19 R |

FOREIGN PATENT DOCUMENTS

| | | | |
|---|---|---|---|
| 2354744 | 5/1975 | Fed. Rep. of Germany | 200/246 |

OTHER PUBLICATIONS

Kofoid, M. J., "Effect of Metal-Dielectric Junction Phenomena on High-Voltage Breakdown Over Insulators in Vacuum," AIEE Transactions, vol. 79(3), pp. 999-1004, Dec. 1960.

Kofoid, M. J., "Phenomena at the Metal-Dielectric Junctions of High-Voltage Insulators in Vacuum and Magnetic Fields," AIEE Transactions, vol. 79(3), pp. 991-999, Dec. 1960.

*Primary Examiner*—James R. Scott

*Attorney, Agent, or Firm*—Richard G. Stahr

[57] ABSTRACT

To reduce the breakdown potential magnitude of the distributor gap between the output tip surface of an ignition distributor rotor output segment and each of the output electrodes of the distributor cap, a layer of a thermoset silicone dielectric material is bonded to at least a portion of the surface area of the rotor output segment and is so located that the interface between the dielectric material and the metal of the rotor output segment nearest the output tip surface is no further than 0.040 inch radially inwardly from the output tip surface.

4 Claims, 5 Drawing Figures

RADIO FREQUENCY INTERFERENCE SUPPRESSING IGNITION DISTRIBUTOR ROTOR

BACKGROUND OF THE INVENTION

This application is a continuation-in-part of co-pending application Ser. No. 848,243, filed Nov. 3, 1977 now abandoned.

The subject invention is directed to an ignition distributor rotor and, more specifically, to a radio frequency interference suppressing ignition distributor rotor.

Various studies have shown that one of the sources of motor vehicle radio frequency interference radiation is the breakdown of the arc gap between the output tip surface of the ignition distributor rotor output segment and each of the circumferentially disposed distributor cap output terminals. This arc gap is generally termed the "distributor gap" and hereinafter will be so referred to.

These studies indicate that the higher the voltage required to breakdown the distributor gap, the greater is the radio frequency interference radiation and, consequently, that the radio frequency interference generated across the distributor gap is substantially reduced with a reduction of the distributor gap breakdown voltage. One way of reducing the radio frequency interference radiation generated across the distributor gap, therefore, is to reduce the magnitude of distributor gap breakdown voltage. These studies further indicate that excessive radio frequency interference radiation is produced when the distributor gap breakdown voltage exceeds 12 kilovolts. As it is necessary that free electrons be provided to initiate an arc across the distributor gap and since the number of free electrons provided is determined by the available charge or electric field intensity, the distributor gap breakdown voltage may be reduced by producing a higher electric field intensity in the vicinity of the distributor gap. In this regard, tests show that the distributor gap breakdown voltage is inversely proportional to the electric field intensity, the greater the electrical field intensity, the lower the breakdown voltage. Various testing of bulk dielectric materials secured to distributor rotor output segments for the purpose of reducing distributor gap radio frequency interference radiation have been conducted. During these tests, it was observed that certain dielectric materials, such as the epoxies, an adhesive marketed by Deylon Industries, Inc. under the trade name "Superbond Cement" and foamed polyurethane with barium titanate are ineffective to reduce distributor gap breakdown voltage and that silicone based dielectric materials, a compound of silicon oxide and zinc oxide and various ceramics and glasses reduce distributor gap breakdown voltage. Microscopic studies of rotor output segments to which the aforementioned materials were applied reveal clear differences at the interface between the dielectric material and the metal of the distributor rotor output segment for those materials that do not reduce distributor gap breakdown voltage and for those materials that do reduce distributor gap breakdown voltage. With those dielectric materials that do not reduce distributor gap breakdown voltage, the bond between the dielectric material and the metal of the distributor rotor output segment is so tight that no voids are readily observable at the interface, even after service aging. With those dielectric materials that do reduce distributor gap breakdown voltage, the bond between the dielectric material and the metal of the distributor rotor output segment is rough, consequently, cracks or voids are present at the interface between the dielectric material and the metal of the rotor output segment. At lower pressures with the dielectric materials that do reduce distributor gap breakdown voltage, less than 60 kPa, a blue glow was visible all around the interface region with the regular spark trace in the main distributor gap. At even lower pressures, less than 30 kPa, the spark trace disappeared and the blue glow spread across the entire gap region. Further, the reduction of distributor gap breakdown voltage is observed only when the dielectric material is applied to the cathode, no noticeable reduction of distributor gap breakdown voltage is observed when it is applied to the anode. With respect to the dielectric materials that do reduce distributor gap breakdown voltage, the observation of voids at the interface between the dielectric material and the metal of the rotor output segment and of the blue glow visible around this interface region indicates that a very strong electric field exists near the interface region to thereby produce a localized discharge. It is believed that the void or voids at the dielectric material-rotor output segment metal interface effect a greatly intensified electric field at this interface region. Further, it is believed that the electric field intensification factor is proportional to the dielectric constant of the dielectric material employed and that the minimum dielectric constant should be of the order of 4. With this intensified electric field, electrons can be easily "pulled" out of the cathodic rotor output segment metal. Once electrons are pulled out of the cathode under the intensified electric field, they produce a local discharge in the air near the dielectric-metal interface region. For low air pressure, the mean free paths of electrons are large, therefore, the discharge at the interface region can quickly propagate or avalanche across the whole distributor gap region. At atmospheric pressure, however, the discharge will be confined to a very localized region unless the electric field immediately outside this region is strong enough to support the avalanche process. Therefore, in order to realize the local discharge phenomena to induce a low impulse breakdown voltage in the distributor gap, the local discharge must take place where the electric field outside the interface region is strong and where it is close to the distributor gap. This localized discharge significantly reduces the distributor gap breakdown voltage and, as a consequence, significantly reduces distributor gap radio frequency interference radiation. In the automotive art, the rotor output segment is the cathode electrode of the distributor gap.

Briefly, the reason that the bonding of a bulk dielectric material on an ignition distributor rotor output segment in close proximity to the distributor gap is effective to reduce distributor gap radio frequency interference radiation is that the void or voids existing at the interface between the bulk dielectric material and the metal surface of the rotor output segment produces an intensified local electric field that is strong enough to pull electrons out of the metal surface of the rotor output segment to produce a local discharge that, in turn, provides sufficient initiatory electrons at a reduced voltage to facilitate a low distributor gap breakdown voltage.

Because of the importance of the reduction of distributor gap generated radio frequency interference radiation, an ignition distributor rotor that includes an arrangement that substantially reduces the distributor gap breakdown voltage is desirable.

SUMMARY OF THE INVENTION

It is, therefore, an object of this invention to provide an improved ignition distributor rotor.

It is another object of this invention to provide an improved ignition distributor rotor that substantially reduces distributor gap radio frequency interference radiation.

It is a further object of this invention to provide an improved ignition distributor rotor having a layer of thermoset dielectric material bonded to at least a portion of the longitudinal surface area of the rotor segment in close proximity to the rotor segment output tip surface.

In accordance with this invention, a radio frequency interference suppressing ignition distributor rotor is provided wherein a layer of a thermoset silicone dielectric material is bonded to at least a portion of the longitudinal surface area of the rotor segment in close proximity to the rotor segment output tip surface.

BRIEF DESCRIPTION OF THE DRAWINGS

For a better understanding of the present invention, together with additional objects, advantages and features thereof, reference is made to the following description and accompanying drawing in which.

In the several figures of the drawing, like elements have been assigned like numerals of reference.

DESCRIPTION OF THE PREFERRED EMBODIMENTS

Figure 1:
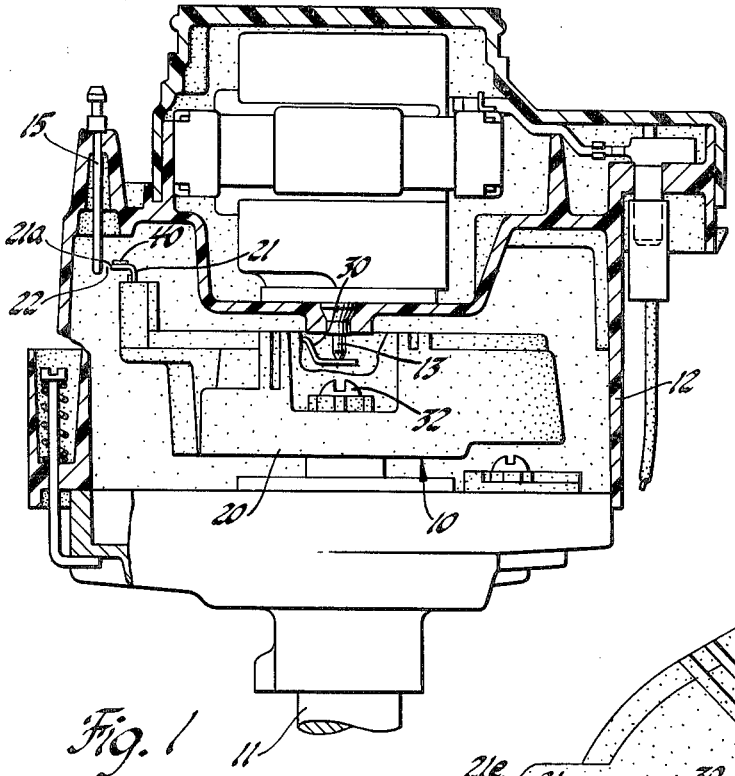
FIG. 1 is a vertical section view of a portion of an ignition distributor showing the distributor rotor of this invention mounted therein.

As is well known in the automotive art, the ignition. distributor rotor 10, FIG. 1, is rotated by a driving shaft 11, usually gear coupled to the camshaft of the associated internal combustion engine, within a distributor cap 12 having a center input terminal 13, to which is connected one end of the associated ignition coil secondary winding, and a plurality of output terminals, one of which is shown at 15, circumferentially disposed about the rotor 10 axis of rotation to which the engine spark plugs are connected through respective spark plug leads. Although only one distributor output terminal is shown in FIG. 1, in which the distributor cap 12 is illustrated in cross section, it is to be specifically understood that an output terminal is provided for each of the engine spark plugs and that they are circumferentially disposed about the center input terminal in a manner well known in the automotive art.

Figure 4:
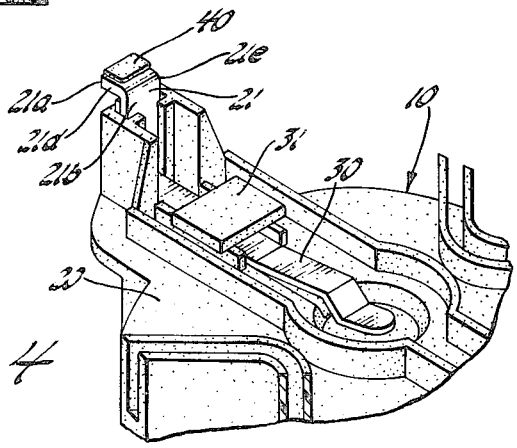
FIG. 4 is a perspective view of a portion of the distributor rotor of this invention.

The ignition distributor rotor of this invention comprises a body member 20 of an electrical insulating material adapted to engage and be rotated about an axis of rotation by driving shaft 11 and a rotor output segment 21 of an electrically conductive material such as copper supported by body member 20. Rotor output segment 21 extends in a direction toward and terminates radially inwardly from the circumferentially disposed distributor output terminals. The cross section surface area of rotor output segment 21 at the extremity thereof nearest the circumferentially disposed distributor output terminals defines an output tip surface 21*a* that extends substantially parallel to the axis of rotation of body member 20 and which, while rotor output segment 21 is rotated with body member 20, traces a circular path radially inwardly from the circumferentially disposed distributor output terminals by a predetermined distributor gap 22. Without intention or inference of a limitation thereto, rotor output segment 21 is illustrated in the drawing as being of a rectangular cross section having opposite edge surfaces 21*d* and 21*e*, FIG. 4. With this embodiment, the top and bottom flat face surfaces 21*b* and 21*c* define, at the extremities thereof nearest the circumferentially disposed distributor output terminals, the top and bottom edge boundaries of output tip surface 21*a* that extends substantially parallel to the axis of rotation of body member 20.

Rotor output segment 21 may be placed in electrical circuit contact with center electrode 13 through an elongated spring contact member 30 of an electrically conductive material such as copper or stainless steel that is arranged to be in electrical contact with center input terminal 13 of distributor cap 12 and is maintained in intimate electrical contact with rotor output segment 21 along engaging surfaces of both by a retaining member 31. Alternatively, rotor output segment 21 may be of a sufficient length to electrically contact center input terminal 13. In a practical application, the electrical insulating material of which body member 20 is made is a 30% glass reinforced thermoplastic polyester molding material. Body member 20 may be secured to the distributor centrifugal weight base, not shown, by screws, one of which is illustrated in FIG. 1 and referenced by the numeral 32. As the distributor centrifugal weight base is rotated by shaft 11 in a manner well known in the automotive art, body member 20 is rotated therewith about a vertical axis of rotation as viewing FIG. 1. One example of an ignition distributor with which the distributor rotor of this invention may be used is described in U.S. Pat. No. 3,923,028, Campbell et al, which issued Dec. 2, 1975 and is assigned to the same assignee as is this invention. It is to be specifically understood, however, that any other arrangement through which body member 20 is adapted to engage and be rotated by driving shaft 11 may be employed without departing from the spirit of this invention.

Figure 2:
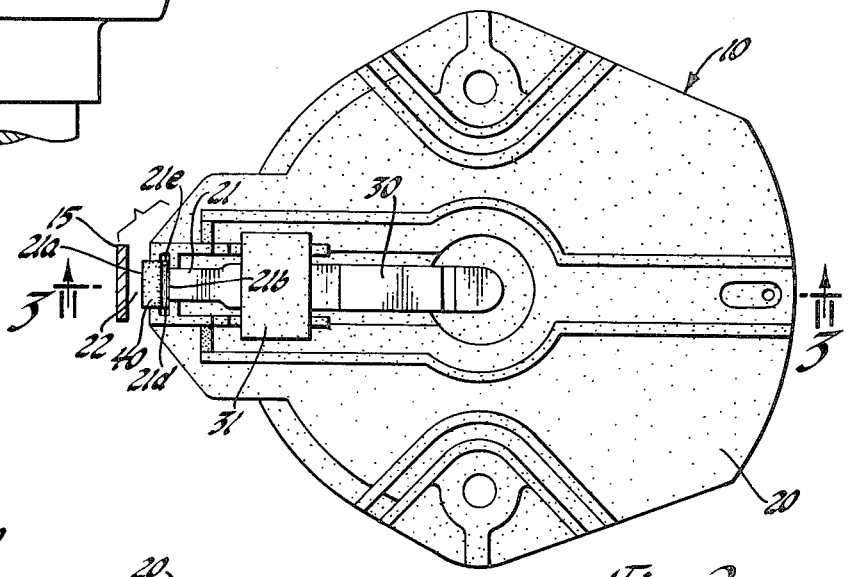
FIG. 2 is a top view of the distributor rotor of this invention showing, in addition, the relationship between the rotor segment output tip surface and one of the distributor output terminals.
Figure 3:
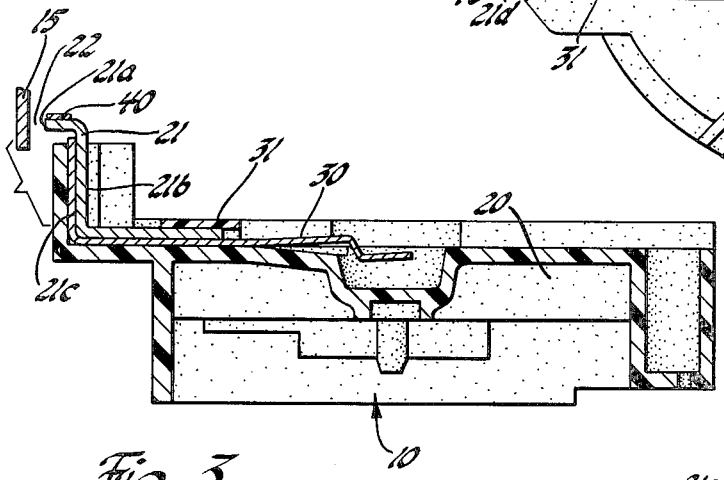
FIG. 3 is a section view of FIG. 2 taken along line 3—3 and looking in the direction of the arrows.

In the actual embodiment illustrated in the drawing, contact member 30 is shown to be an elongated spring contact member of an electrically conductive material such as copper or stainless steel in intimate electrical contact with rotor output segment 21 and having one end thereof in electrical contact with center input terminal 13 of distributor cap 12. With this arrangement, the ignition spark potential produced by the secondary winding of the associated ignition coil may be delivered to successive ones of the circumferentially disposed distributor output terminals as rotor body member 20 is rotated by shaft 11 in timed relationship with an associated internal combustion engine, in a manner well known in the automotive art. This circuit may be traced through input terminal 13, contact member 30, rotor output segment 21 and the distributor gap 22 between the rotor segment 21, output tip surface 21*a* and each of the distributor output terminals. The distributor gap 22 is best seen in FIGS. 1, 2 and 3 of the drawing.

As has been previously brought out, the higher the voltage required to break down the distributor gap, the higher is the radio frequency interference radiation. Consequently, one way of reducing the distributor gap radio frequency interference radiation is to reduce the magnitude of the voltage required to break down the distributor gap. Also, as has been previously brought out, it is necessary that free electrons be provided to initiate an arc across the distributor gap and, since the number of free electrons provided is determined by the available charge or the electric field intensity, one way of reducing the distributor gap breakdown voltage is to provide a higher electric field intensity in the vicinity of the distributor gap. In the automotive art, the ignition spark creating potential produced by the ignition coil secondary winding and applied to the engine spark plugs through the distributor rotor is of a negative polarity. As a consequence, the distributor rotor output segment is the cathode electrode of the distributor gap.

Figure 5:
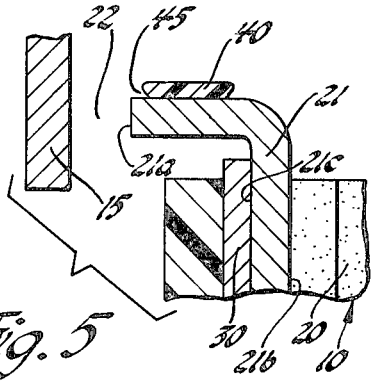
FIG. 5 is an enlarged view of a portion of FIG. 3 showing one type of a void formed at the interface between a silicone dielectric material and the metal of the distributor rotor output segment.

To increase the electric field intensity at the distributor gap in an actual embodiment, a layer of a commercially available silicone rubber dielectric material 40 that is marketed by the General Electric Company under the designation RTV-102, White is bonded to at least a portion of the longitudinal surface area of rotor output segment 21 and located in close proximity to the rotor output segment 21 output tip surface 21*a*. The interface between the layer of silicone rubber dielectric material 40 and the metal of rotor output segment 21 provides a void or gap 45 as shown in FIG. 5 that intensifies the electric field in the vicinity of the distributor gap 22. This localized intensified electric field at the interface between the silicone rubber dielectric layer and the metal surface of the rotor output segment enhances electron discharge from the metal of rotor output segment 21 for the reason that this intensified electric field produces a local corona discharge. The radiation resulting from this local corona discharge causes electrons to be emitted into the distributor gap. Upon the initiation of emission of electrons into the distributor gap, the effect avalanches, a condition which results in a significantly reduced distributor gap breakdown voltage. It may be noted that, since the emission of electrons from the metal of the rotor output segment 21 is required to initiate the distributor gap discharge, rotor output segment 21 must be negatively polarized as it is in the automotive art as hereinabove explained. The silicone rubber dielectric material employed in the actual embodiment cured at room temperature. During the curing process, the edges of this material pulled slightly away from the metal surface of the rotor output segment. As a result, a void or gap 45 as illustrated in FIG. 5 was formed between the dielectric material and the metal of the rotor output segment. The silicone dielectric material employed in the actual embodiment (silicone rubber) has a dielectric constant of approximately 4.7. In the actual embodiment with a distributor rotor of the type illustrated in the drawing, the breakdown voltage across a 3 millimeter distributor gap is reduced from 20 kilovolts to 8 kilovolts.

Actual observations indicate that (1) the interface between the silicone dielectric material and the metal of the rotor output segment nearest the rotor segment output tip surface should be within a range of 0" to 0.040" radially inwardly from the output tip surface, that (2) it is extremely important that the rotor output segment output tip surface be absolutely free of any of the silicone dielectric material and that (3) the silicone dielectric material not extend beyond the edge of the rotor output segment output tip surface as both of these latter two conditions result in intolerable "in car" FM radio receiver noise. Therefore, it is essential that the silicone dielectric material remain in the position at which it is initially located and, further, it must be mechanically durable to withstand rough treatment. The essential requirements of the silicone dielectric material employed, therefore, are that (1) it must be a material that readily adheres to the metal surface of the rotor output segment, (2) is must be mechanically durable, (3) it absolutely must not flow or melt at the elevated temperature encountered within the ignition distributor cap and thereby flow into the distributor gap and (4) it must provide a void or voids at the dielectric material-rotor output segment metal interface. Preferably, the void or voids at the interface region are within a range of the order of ten microns minimum to one millimeter maximum. Silicone dielectric materials of the thermoset type satisfy these requirements. In this regard, the term "thermoset" means that the material does not soften with heat and it applies to those silicon dielectric materials such as silicone rubber that are room temperature vulcanizable. A silicone rubber dielectric material is employed in the actual embodiment for the reason that it has all of the hereinabove set forth essential requirements. It is to be specifically understood, however, that other silicone based dielectric materials that satisfy the four essential requirements hereinabove set forth and also any other dielectric material such as the aforementioned ceramics, glasses and the compound of silicon and zinc oxides, for example, that has the four essential requirements may be employed without departing from the spirit of the invention so long as it is not bonded to the rotor output segment so tightly as to prevent the formation of a void or voids at the dielectric material-rotor segment interface.

Although the layer of silicone dielectric material is shown in the drawing to be bonded to the top flat face surface 21*b* of rotor output segment 21, it is to be specifically understood that this layer of silicone dielectric material may be secured to the bottom flat face surface 21*c* or both of these surfaces so long that it does not extend beyond nor cover any portion of output tip surface 21*a*. Further, the layer of silicone dielectric material may be employed with rotor output segments having cross sections other than rectangular.

While a preferred embodiment of the present invention has been shown and described, it will be obvious to those skilled in the art that various modifications and substitutions may be made without departing from the spirit of the invention which is to be limited only within the scope of the appended claims.

What is claimed is:

1. A radio frequency interference suppressing ignition distributor rotor of the type adapted to be rotated about its axis within a distributor cap having a plurality of output terminals circumferentially disposed about the rotor axis of rotation comprising: a body member of an electrical insulating material rotatable about an axis of rotation; a rotor segment of an electrically conductive material supported by said body member and having at least top and bottom flat face surfaces that define, at the extremities thereof nearest said output terminals, the top and bottom edge boundaries of an output tip surface that extends substantially parallel to said axis of rotation of said body member and which, while said rotor segment is rotated with said body member, traces a circular path radially inwardly from said circumferentially disposed distributor cap output terminals by a predetermined distributor arc gap; and a layer of silicone rubber dielectric material secured to at least one of said rotor segment top and bottom flat face surfaces and so located that the terminating edge thereof nearest said output tip surface is within a range of 0" to 0.040" radially inwardly from the edge boundary of said output tip surface, said silicone rubber layer being effective to reduce the breakdown potential across said distributor arc gap whereby the radiation of the radio frequency interference generated by an electrical discharge across said distributor arc gap is effectively suppressed.

2. A radio frequency interference suppressing ignition distributor rotor of the type adapted to be rotated about its axis within a distributor cap having a plurality of output terminals circumferentially disposed about the rotor axis of rotation comprising: a body member of an electrical insulating material rotatable about an axis of rotation; a rotor segment of an electrically conductive material supported by said body member and having at least top and bottom flat face surfaces that define, at the extremities thereof nearest said output terminals, the top and bottom edge boundaries of an output tip surface that extends substantially parallel to said axis of rotation of said body member and which, while said rotor segment is rotated with said body member, traces a circular path radially inwardly from said circumferentially disposed distributor cap output terminals by a predetermined distributor arc gap; and a layer of silicone rubber material having a minimum dielectric constant of the order of 4.0 secured to at least one of said rotor segment top and bottom flat face surfaces and so located that the terminating edge thereof nearest said output tip surface is within a range of 0" to 0.040" radially inwardly from the edge boundary of said output tip surface, said silicone rubber layer being effective to reduce the breakdown potential across said distributor arc gap whereby the radiation of the radio frequency interference generated by an electric discharge across said distributor arc gap is effectively suppressed.

3. A radio frequency interference suppressing ignition distributor rotor of the type adapted to be rotated about its axis within a distributor cap having a plurality of output terminals circumferentially disposed about the rotor axis of rotation comprising: a body member of an electrical insulating material rotatable about an axis of rotation; a rotor segment of an electrically conductive material supported by said body member and extending in a direction toward and terminating radially inwardly from said circumferentially disposed distributor cap output terminals, the cross section surface area thereof at the extremity thereof nearest said output terminals defining an output tip surface that extends substantially parallel to said axis of rotation of said body member and which, while said rotor segment is rotated with said body member, traces a circular path radially inwardly from said circumferentially disposed distributor cap output terminals by a predetermined distributor arc gap; and a layer of silicone rubber dielectric material secured to at least a portion of the longitudinal surface of said rotor segment and so located that the terminating edge thereof nearest said output tip surface is within a range of 0" to 0.040" radially inwardly from said output tip surface, said silicone rubber layer being effective to reduce the breakdown potential across said distributor arc gap whereby the radiation of the radio frequency interference generated by an electrical discharge across said distributor arc gap is effectively suppressed.

4. A radio frequency interference suppressing ignition distributor rotor of the type adapted to be rotated about its axis within a distributor cap having a plurality of output terminals circumferentially disposed about the rotor axis of rotation comprising: a body member of an electrical insulating material rotatable about an axis of rotation; a rotor segment of an electrically conductive material supported by said body member and having at least top and bottom flat face surfaces that define, at the extremities thereof nearest said output terminals, the top and bottom edge boundaries of an output tip surface that extends substantially parallel to said axis of rotation of said body member and which, while said rotor segment is rotated with said body member, traces a circular path radially inwardly from said circumferentially disposed distributor cap output terminals by a predetermined distributor arc gap; and a coating of a thermoset silicone dielectric material bonded to at least one of said rotor segment top and bottom flat face surfaces and so located that the interface between the silicone dielectric material and the rotor segment material nearest said output tip surface is within a range of 0" to 0.040" radially inwardly from the edge boundary of said output tip surface, said interface between said silicone dielectric material and the material of said rotor segment having at least one area in which there is a void between said dielectric material and the material of said rotor segment for enhancing the electrostatic field at this area to thereby effect a reduction of the breakdown potential across said distributor arc gap whereby the radiation of the radio frequency interference generated by an electrical discharge across said distributor arc gap is effectively suppressed.

* * * * *

UNITED STATES PATENT AND TRADEMARK OFFICE

CERTIFICATE OF CORRECTION

PATENT NO. : 4,186,286

DATED : January 29, 1980

INVENTOR(S) : Wey-Chaung Kuo and Hwei P. Hsu

It is certified that error appears in the above-identified patent and that said Letters Patent are hereby corrected as shown below:

Column 6, line 27, "silicon" should read -- silicone --.

Column 7, line 45, "electric" should read -- electrical --.

Signed and Sealed this

*Eighth* Day of *July 1980*

[SEAL]

*Attest:*

SIDNEY A. DIAMOND

*Attesting Officer*

*Commissioner of Patents and Trademarks*